US006098382A

United States Patent [19]

Diebold

[11] Patent Number: 6,098,382

[45] Date of Patent: Aug. 8, 2000

[54] SET OF DOCUMENT ENVELOPES, METHOD AND DEVICE FOR USING THEREOF AND METHOD FOR MAKING THE SET

[75] Inventor: Edgard Diebold, Baillargues, France

[73] Assignee: Pockad, S.A.R.L., Baillargues, France

[21] Appl. No.: 09/157,084

[22] Filed: Sep. 18, 1998

Related U.S. Application Data

[63] Continuation-in-part of application No. PCT/FR97/00448, Mar. 13, 1997.

[51] Int. Cl.[7] ..... B65B 43/26

[52] U.S. Cl. ..... 53/569; 53/381.5; 53/381.7

[58] Field of Search ..... 53/460, 381.5, 53/381.7, 381.1, 492, 569; 493/196, 210, 192, 186, 211

[56] References Cited

U.S. PATENT DOCUMENTS

| | | | |
|---|---|---|---|
| 4,514,182 | 4/1985 | VerMehren | 493/216 |
| 4,769,969 | 9/1988 | Minami | 493/216 |
| 5,071,399 | 12/1991 | Ashby | 493/216 |
| 5,233,812 | 8/1993 | Coppola | 53/460 |
| 5,282,350 | 2/1994 | Crowley | 53/381.5 |
| 5,913,796 | 6/1999 | Emigh | 53/569 |

FOREIGN PATENT DOCUMENTS

| | | | |
|---|---|---|---|
| 39 03 578 A1 | 11/1990 | Germany . | |
| 0249430 | 10/1989 | Japan | 493/216 |
| 2 245 744 | 8/1992 | United Kingdom . | |

*Primary Examiner*—Eugene Kim
*Attorney, Agent, or Firm*—Graybeal Jackson Haley LLP

[57] ABSTRACT

A set of document envelopes (1) suitable for continuous use on an automatically or semiautomatically operating device is disclosed. The device for carrying out the method of use carries out a number of steps on the set of envelopes (1) arranged in a row on a continuous strip (8), i.e. the strip (8) is fed past a work station (10) comprising input guide means (11), output guide means (12) and a strip feeding means (13); each envelope is opened by a means (14) and a document is inserted by a means (15), and each envelope (1) is grasped by a means (16) and separated form the carrier (8). The envelope/strip assembly consists of a stack of at least three continuous strips in which only the two strips defining said envelopes are cut or pre-cut.

7 Claims, 4 Drawing Sheets

SET OF DOCUMENT ENVELOPES, METHOD AND DEVICE FOR USING THEREOF AND METHOD FOR MAKING THE SET

This is a continuation-in-part of co-pending International Application PCT/FR97/00448 filed on Mar. 13, 1997 designating the United States.

TECHNICAL FIELD

The invention refers to a set of document envelopes, a method and a device for using said set and a method for manufacturing the set of envelopes.

BACKGROUND ART

Known envelopes of the kind involved generally include:

- a rear sheet, generally in plastic material, with glue on its external face, provided either with a slot for inserting the documents or a flap, glue coated or not, designed to close said envelope;
- a front sheet, generally in transparent plastic material pre-printed, integral with said rear sheet by means of lengthwise and crosswise tie bands on the contacting faces of said sheets, so that they form the properly so-called document envelopes;
- a laminar protecting support, generally in non adhesive paper of the silicone coated kind, located against the gluing face of the rear sheet and which includes or not a slot superimposed over the previous slot serving to insert the documents.

Said envelopes are always presented to be used one by one without any simple operating device having been devised namely for ungluing the silicone coated paper, introducing the documents and depositing the envelope on the object involved.

In its present manual use, handling times are very high, over all for the societies the business of which consists of the sales by mail or by the several quick shipping offices.

DISCLOSURE OF THE INVENTION

The invention therefore tries to embody envelopes serially presented on a continuous support, a method for using said envelopes, a device suitable to automatically perform the operations of locating on the workstation, opening envelopes, inserting documents, separating from the support and putting said envelopes down on parcels, as well as the method for making said set. The envelopes of the kind involved are arranged, in a row, by their gluing face, on a laminar protecting support which appears in the form of a continuous strip, either crumpled on levels which include at least one envelope, or wound, located in a box for their automatic or semi-automatic use.

With such a feature of the envelopes, only for the grasping operation thereof and separating them from the silicone coated support, handling time gain ranges within 50 and 80% against a manual use as it is existing now.

In addition, automatizing the other operations becomes also possible in a simple way with an added gain of time to the above mentioned.

The invention also refers to methods for making and using and the device for carrying out said method of use.

The characteristics and advantages of the invention will be more apparent from the detailed description below of at least one preferred embodiment thereof given as an example and shown in drawings attached.

DETAILED DESCRIPTION OF THE PREFERRED EMBODIMENTS

Figure 1:
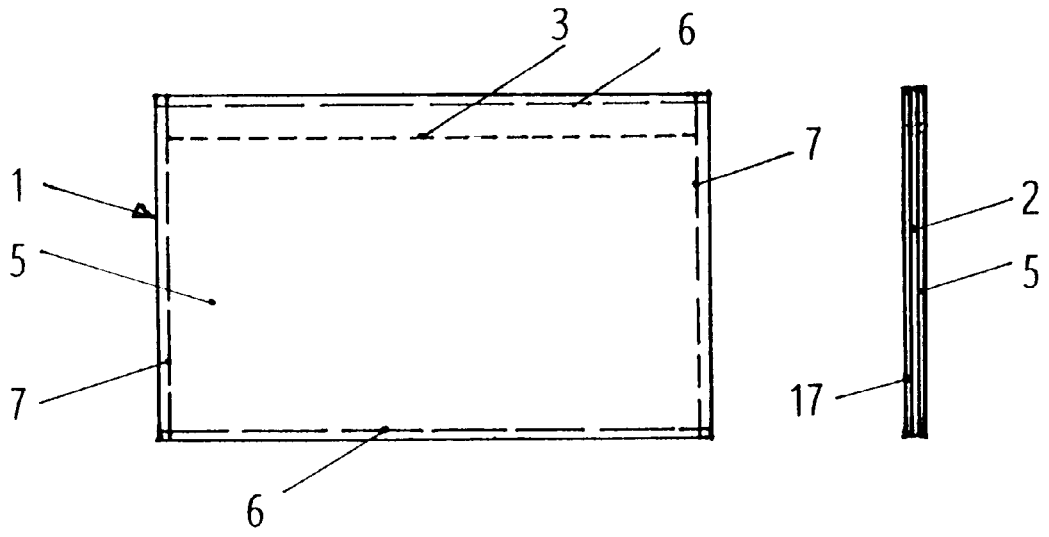
FIG. 1 shows in a top and side view a known document envelope of the kind involved, in a flat arrangement.
Figure 2:
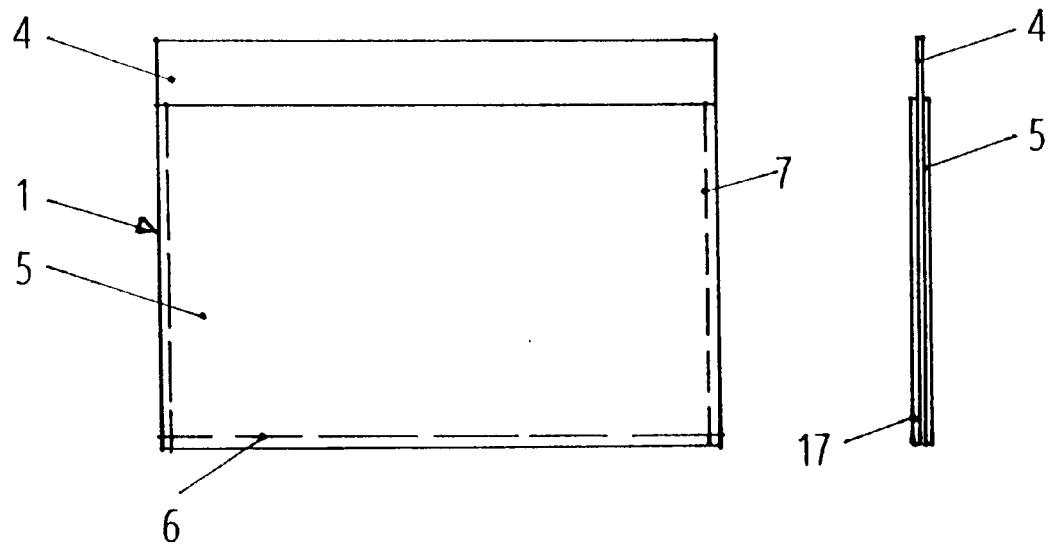
FIG. 2 shows in a top and side view an alternative embodiment of said envelope provided with a flap, in a flat arrangement.

The document envelopes (1) shown in FIG. 1 and 2 are of the kind which include:

- a rear sheet (2), generally of plastic material or more specifically of paper or any other material, with glue on its external face, provided either with a slot (3) for inserting the documents or a flap (4), glue coated or not, designed to close said envelope;
- a front sheet (5), generally of transparent plastic material or more specifically of paper, with or without window, or any other material, generally provided with pre-imprints, integral with said rear sheet (2) by means of lengthwise (6) and crosswise (7) tie bands or glue on the contacting faces of said sheets (2) and (5), so that they form the properly so-called document envelopes.

Said sheets are associated to a laminar protecting support (17), generally in non adhesive paper of the silicone coated kind, located against the gluing face of the rear sheet and which includes (FIG. 1) or not (FIG. 2) a slot superimposed over the previous slot (3).

Figure 3:
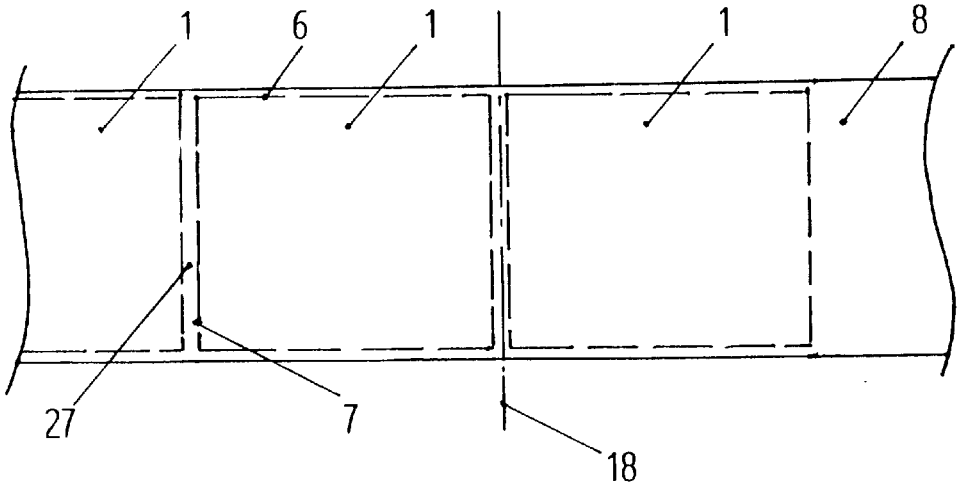
FIG. 3 shows some document envelopes according to the invention arranged in a row on a continuous strip.

The document envelopes (1), shown in FIG. 3, are arranged in a row, through their gluing face superimposed on a laminar protecting support, generally in non adhesive paper of the kind silicone coated, which is in form of a continuous strip (8) arranged in a roll or folded and located in a box (9) for the use of said set (1, 8) by an automatic device.

Figure 4:
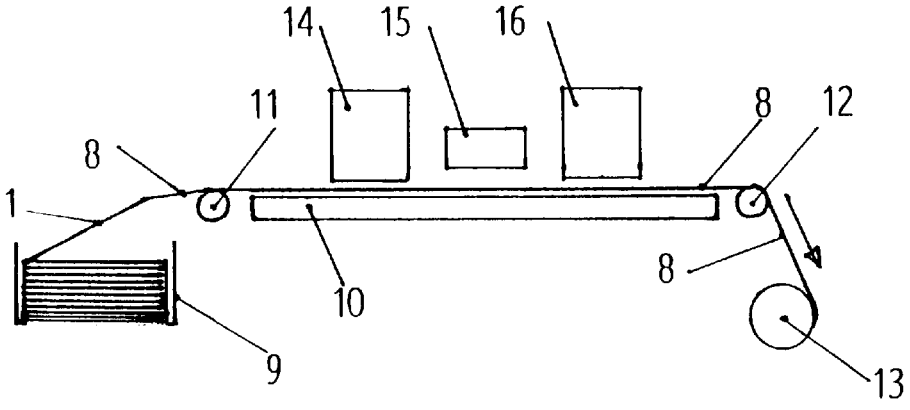
FIG. 4 is a schematic view of the device for using document envelopes in continuous.

The method of using (FIG. 4) said envelopes, arranged in a row on a continuous strip, successively and automatically consists of:

- displacing in continuous the strip (8) bearing envelopes (1) in front or a workstation (10) by means of a lengthwise traction exerted on said strip;
- opening each envelope by an action exerted on at least one of its sheets (2, 5) and introducing within it, in parallel to said plane and perpendicularly to the strip (8) running direction, the documents involved;
- separating each envelope (1) from the continuous support (8) and putting it down on the object involved.

The device (FIG. 4) for carrying out the method for use of the set of document envelopes includes:

- at the entrance of the workstation (10), an input guiding means (11) for the complex strip (1, 8) and, at the exit of said workstation, a guiding means (12) for the strip (8) separated from the envelopes (1), lengthwise associated to a traction means (13) of said strip;
- at a workstation (10) plane area, A means (14) for opening each envelope, associated to a means (15) for inserting documents actuated with an alternate movement parallel to said plane (10) and perpendicular to the strip (8) running direction;
- at the exit of the workstation (10) plane, a means (16) for grasping each envelope and depositing it on corresponding object.

According to different embodiments of the invention:

the guiding means (11) and (12) can be of the kind including rotating free rolls and the traction means (13) can be of the rolling type associated to a motor reducer;

the means (14) for opening envelopes can be of the type with pneumatic feelers and the means (15) for introducing documents can be of the type with pneumatic or electromechanical clamps;

the means (16) for grasping and depositing envelopes can be of the type with feelers or pneumatic or electromechanical clamps;

According to an particular embodiment of the invention, the means for grasping and putting down envelopes can be constituted from the same means (14) for opening envelopes which in this case is actuated with a lateral movement for depositing envelopes on corresponding objects. The strip (8) can include, between two consecutive envelopes, folding lines (18) having less strength (microperforations or another solution) for the concertina folding appearance.

Figure 5:
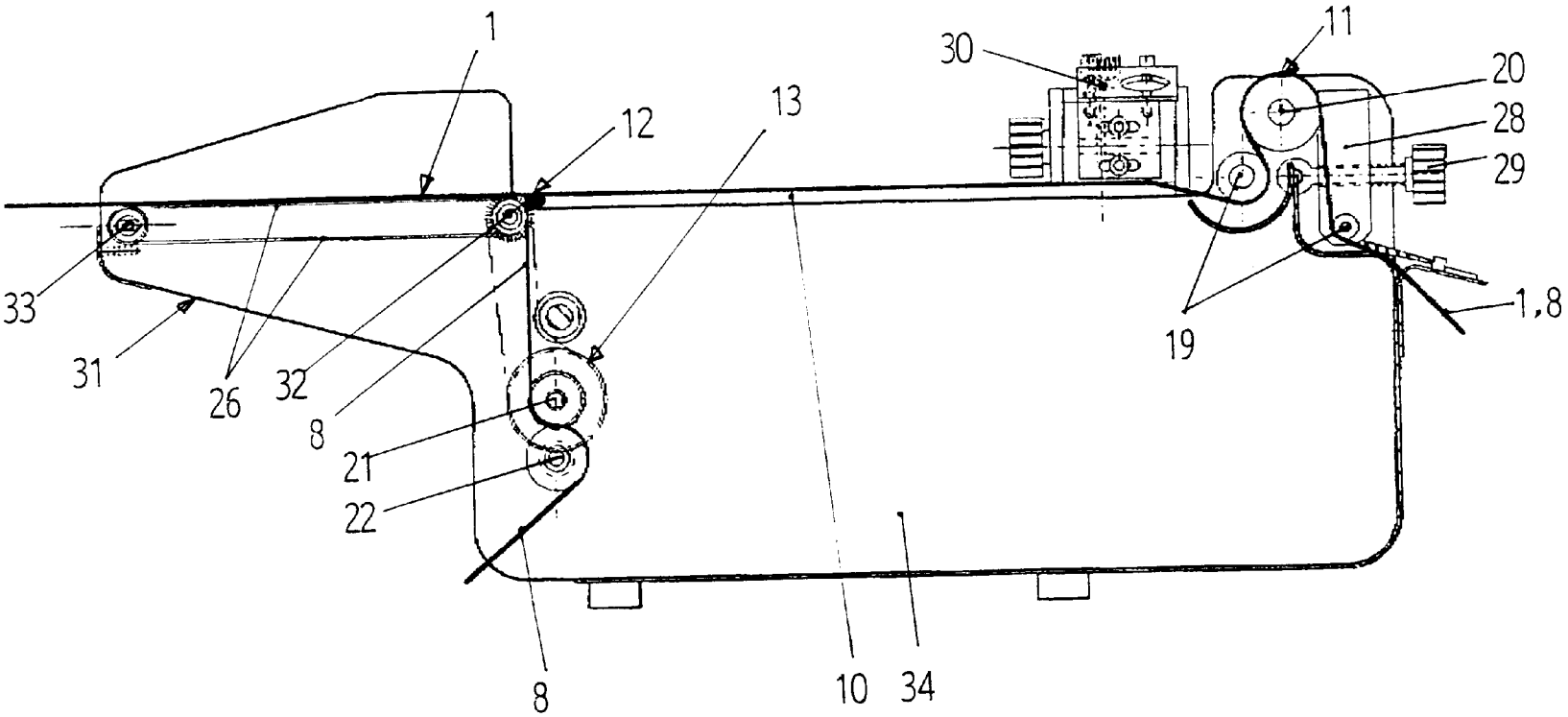
FIG. 5 is a side, elevational view of the base device.
Figure 6:
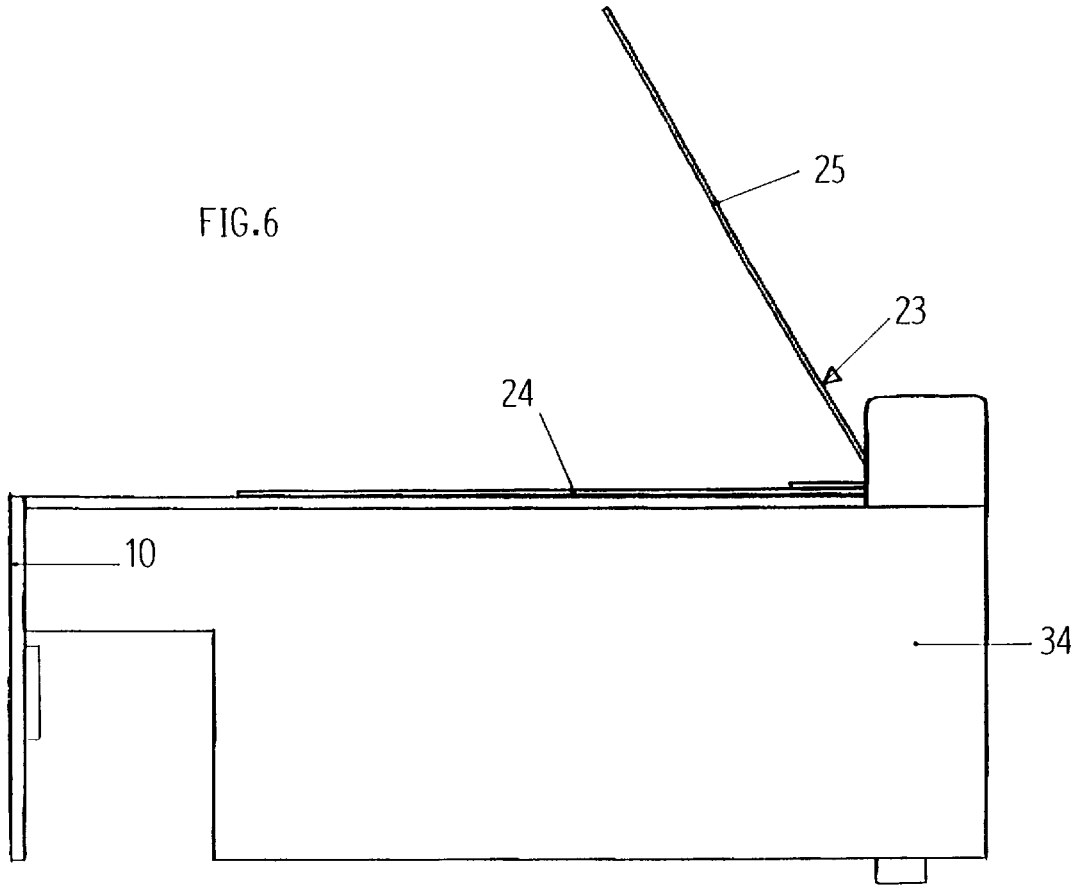
FIG. 6 is a side, elevational view of the module for inserting documents associated to the base device.

A device corresponding to a preferred embodiment of the invention is shown in FIGS. 5 and 6.

The guiding means (11) includes free rolls (19) associated to a braking roll (20) for the strip (8) tightening.

The guiding means (12) which is constituted by a bar is associated to a traction means (13) constituted by two rolls (21, 22) one of which is a driving roll which grips the strip (8) so that it drives it.

The means (14) for opening each envelope (1) and the means (15) for inserting documents are constituted by a same set (23), shuttlelike, which includes hinged panels, one (24) fixed and the other (25) moveable, between which the document to be located in the envelope is placed and which is displaceable within said envelope to deposit said document within it.

When the shuttler member with hinged panels (24, 25) moves onward, some fingers (not shown) laterally located, pivot to open the envelope (1).

Internal stops, sliding on one of the panels (24, 25) of the shuttle member, lock (prevent) within the envelope (1) the feeding back of documents during the running back of said shuttle member (said stops are not shown).

The means (16) for grasping the envelope (1) is constituted by a conveying belt (26) located at the exit of the workstation (10) after the bar (12) separating the strip (8) from the envelopes (1).

Roll (20) braking is carried out by means of a thrust pad (28) and an adjusting screw (29).

A cell (30) for identifying the envelopes moving on is located over the workstation (10). It offers the possibility of step by stop advancement. At the exit of the plane (10) there is the routing station (31) of the envelopes (1) separated from their support (8). This station includes, at the entrance, a rotating brush (32) and, at the exit, a free roll (33).

The conveying belt (26) is for example made of lengthwise belts which are supported by rolls (32) and (33).

Modules (10) and (31) can pertain to same frame (34).

The set (23) includes its own frame which is located perpendicularly to the work plane (10).

The method for making document envelopes (1) of the kind obtained by superimposing:

a first rear strip (2), generally of plastic material, with glue on its external face, provided either with a slot (3) for inserting the documents, or a flap (4), glue coated or not, designed to close said envelope;

a second front strip (5), generally of transparent plastic material provided with pre-imprints, integral with said first strip (2) by means of lengthwise (6) and crosswise (7) tie bands on the contacting faces of said sheets (2,5), so that they form an envelope set (1).

a third strip (8), generally of non adhesive paper of the silicone coated kind, which comes to be positioned along the glue coated face of the first strip (2);

consists in cutting or pre-cutting only the two strips (2) and (5) in the crosswise areas (27) separating two consecutive envelopes (1) and leaving intact the third support strip (8).

If the sheets are of plastic material, cutting or pre-cutting can be performed with a heating wire or bar.

The set of envelopes (1) obtained is constituted by a continuous strip (8) bearing envelopes (1), separated by crosswise areas (27), cut or pre-cut, and arranged in a roll or folded.

Obviously, other variations can be foreseen in:

the materials used (paper, plastic or other), tie bands for the two sheets constituting the envelope (welding, gluing), the different cuts for inserting the documents:

the different means used to perform the different steps relative to the use of the envelopes.

What is claimed is:

1. An apparatus for using a continuous strip of separable document envelopes, the envelopes comprising a rear sheet with glue on an external face with a slot for inserting documents; a front sheet integral with the rear sheet by means of lengthwise and crosswise tie bands on contacting faces of the sheets; and a laminar protecting support located against the external face of the rear sheet the apparatus comprising:

a workstation with an entrance portion to the workstation and an input guiding means proximate the entrance;

an exit portion from the workstation with an exit guiding means proximate the exit;

a workstation plane area disposed between the entrance and the exit;

a lengthwise traction means proximate the exit for urging the strip in the running direction generally from the entrance portion, past the input guiding means, past the workstation plane, past the exit guiding means, to the exit portion;

an opening means proximate the plane area for opening the envelopes on the strip associated with an insertion means proximate the plane area for inserting documents in the envelopes with an alternate movement parallel to the plane and perpendicular to the running direction; and a grasping means proximate the exit for separating the envelopes from the strip and depositing the envelopes on corresponding objects.

2. The apparatus of claim 1, wherein the input guiding means includes at least one rotating free roll associated with a braking roll for tightening the strip.

3. The apparatus of claim 1, wherein the exit guiding means is a bar associated with the lengthwise traction means with a first roll and a second roll for gripping the strip and at least one roll is a driven roll for driving the strip in the running direction.

4. The apparatus of claim 1, wherein the opening means and the insertion means comprise a same set which includes a fixed hinged panel and a movable hinged panel between which documents for insertion in the envelopes are placed, and whereby the set is displaceable within the envelope to deposit the document.

5. The apparatus of claim 4, wherein the same set comprises fingers, located laterally, which pivot to open the envelope when the set moves onward.

6. The apparatus of claim 4, further comprising an internal stop, sliding on the fixed panel or the movable panel to prevent documents from feeding back out of an envelope during a running back of the same set.

7. The apparatus of claim 1, wherein the grasping means comprises a conveying belt located proximate the exit guiding means.

* * * * *